US007361002B2

(12) United States Patent
Ohnishi et al.

(10) Patent No.: US 7,361,002 B2
(45) Date of Patent: Apr. 22, 2008

(54) OIL PUMP

(75) Inventors: Hideaki Ohnishi, Kanagawa (JP); Yasushi Watanabe, Kanagawa (JP); Shoji Morita, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 234 days.

(21) Appl. No.: 10/985,898

(22) Filed: Nov. 12, 2004

(65) Prior Publication Data

US 2005/0106053 A1 May 19, 2005

(30) Foreign Application Priority Data

Nov. 17, 2003 (JP) ..... 2003-386128

(51) Int. Cl.
*F01C 21/16* (2006.01)

(52) U.S. Cl. ..... 418/19; 418/61.3

(58) Field of Classification Search ..... 418/19, 418/61.3

See application file for complete search history.

(56) References Cited

U.S. PATENT DOCUMENTS 2,887,960 A * 5/1959 Tobias ..... 418/21
4,233,003 A * 11/1980 Jeng ..... 418/8
4,408,968 A * 10/1983 Inagaki et al. ..... 418/15
4,752,195 A * 6/1988 Friedrich et al. ..... 417/540
6,974,315 B2 * 12/2005 Dees ..... 418/171
2006/0088431 A1 * 4/2006 Berger ..... 418/19

FOREIGN PATENT DOCUMENTS

JP 2-43482 U 3/1990

OTHER PUBLICATIONS

U.S. Appl. No. 10/984,927, filed Nov. 10, 2004, Ohnishi et al.

* cited by examiner

*Primary Examiner*—Hoang Nguyen
(74) *Attorney, Agent, or Firm*—Foley & Lardner LLP

(57) ABSTRACT

An oil pump to be insatalled to an engine of an automotive vehicle. The oil pump includes a section defining a suction port and a section defining a discharge port. A main unit of the oil pump has a section defining a plurality of pump chambers. Volume of each pump chamber continuously changes to increase and decrease under driving of the engine so as to pressurize oil sucked through the suction port and discharge the oil through the discharge port. A section defining an oil chamber to which the oil flows is provided such that the oil chamber has a vertically upper side which is communicated with the discharge port through a communicating hole.

21 Claims, 5 Drawing Sheets

OIL PUMP

BACKGROUND OF THE INVENTION

This invention relates to improvements in an oil pump driven by an engine, and more particularly to the improvements in the oil pump which is provided with a function of decreasing a pulse pressure in a discharge port.

An oil pump of the type driven by an engine is disclosed in Japanese Utility Model Provisional Publication No. 2-43482. This oil pump is of a trochoid type and has a basic arrangement such that volumes of a plurality of pump chambers formed between an inner rotor and an outer rotor are continuously changed to increase and decrease under a driving force received from an engine, in which oil sucked in a suction port is pressurized in the pump chambers and discharged to a discharge port whose upper section of the discharge port has a closed groove whose upper portion of the closed groove is formed into an air chamber where air is accumulated.

Since this oil pump is provided with the air chamber as the closed groove in communication with the discharge port, a plurality of the pump chambers sequentially open to the discharge port so as to discharge oil to the discharge port, generating pulse pressure. This pulse pressure can be absorbed under a dumping action of the air chamber.

However, in case of this conventional oil pump, when the frequency of the pulsation pressure in the discharge port becomes in arrangement with the resonance frequency of the air chamber, vibration within the air chamber increases, and then air within the air chamber may be rapidly discharged to the discharge port. Air is thus leaked under resonance of the air chamber so that a capability of reducing pulse pressure is rapidly lowered. This affects an actuator and the like driven by the discharged oil. Additionally, rapid change of noise level provides discomfort to passengers. More specifically, the passengers do not sense much discomfort when the noise level of the pump is linearly increased almost in proportion to an engine speed; however, the passengers sense much discomfort when the noise level of the pump is rapidly changed during the rise of the engine speed.

SUMMARY OF THE INVENTION

It is an object of the present invention to provide an improved oil pump which can effectively overcome drawbacks encountered in conventional oil pumps of the similar natures.

Another object of the present invention is provide an improved oil pump which can always stably decrease the pulse pressure in a discharge port regardless of variation in engine speed.

A first aspect of the present invention resides in an oil pump comprising a section defining a suction port and a section defining a discharge port. A main unit is provided including a section defining a plurality of pump chambers. Volume of each pump chamber continuously changes to increase and decrease under driving of an engine so as to pressurize oil sucked through the suction port and discharge the oil through the discharge port. A section defining an oil chamber to which the oil flows is provided such that the oil chamber has a vertically upper side which is communicated with the discharge port through a communicating hole.

A second aspect of the present invention resides in an oil pump comprising a section defining a suction port and a section defining a discharge port. A main unit is provided including a section defining a plurality of pump chambers.

Volume of each pump chamber continuously changes to increase and decrease under driving of an engine so as to pressurize oil sucked through the suction port and discharge the oil through the discharge port. A section defining an oil chamber to which the oil flows is provided such that the oil chamber has a vertically upper side which is communicated with the discharge port through a communicating hole. Additionally, an upper wall defining an upper part of the oil chamber is provided. The upper wall has an inner surface which is inclined relative to a horizontal direction in a manner that the communicating hole is located at the vertically upper side of the oil chamber.

A third aspect of the present invention resides in an oil pump comprising a section defining a suction port and a section defining a discharge port. A main unit is provided including a section defining a plurality of pump chambers. Volume of each pump chamber continuously changes to increase and decrease under driving of an engine so as to pressurize oil sucked through the suction port and discharge the oil through the discharge port. A section defines an oil chamber to which the oil flows. The oil chamber has a vertically upper side. Additionally, a section defining a communicating hole is provided. Through the communicating hole, the vertical upper side of the oil chamber is communicated with the discharge port. The communicating hole has a portion which is adjacent the discharge port. The portion has an opening area for keeping oil within the portion under surface tension of the oil.

The other objects and features of this invention will become understood from the following description with reference to the accompanying drawings.

DETAILED DESCRIPTION OF THE INVENTION

Figure 1:
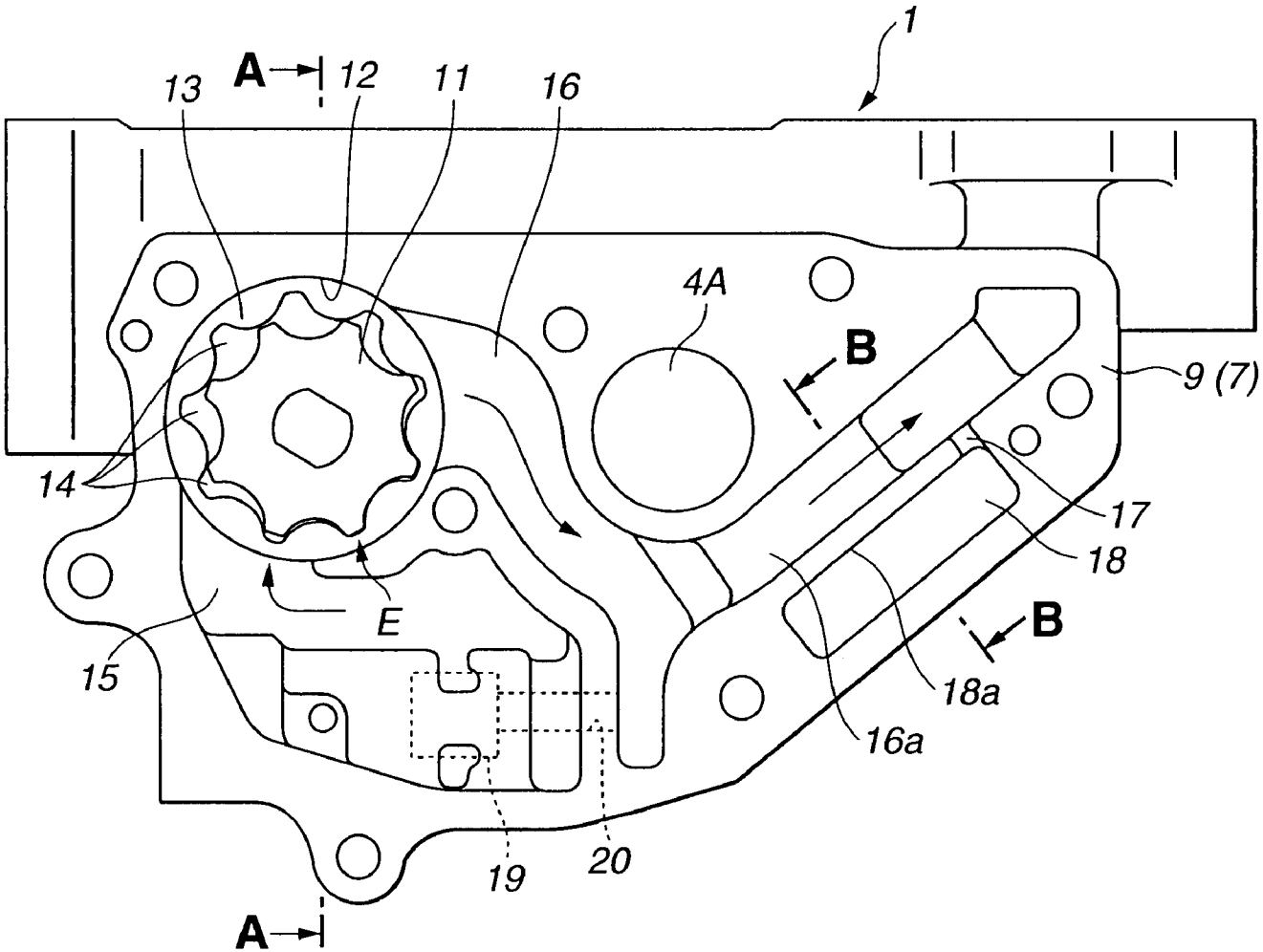
FIG. 1 is an end view taken in the direction of allows substantially along the line C-C of FIG. 2, showing a first embodiment of an oil pump according to the present invention.
Figure 2:
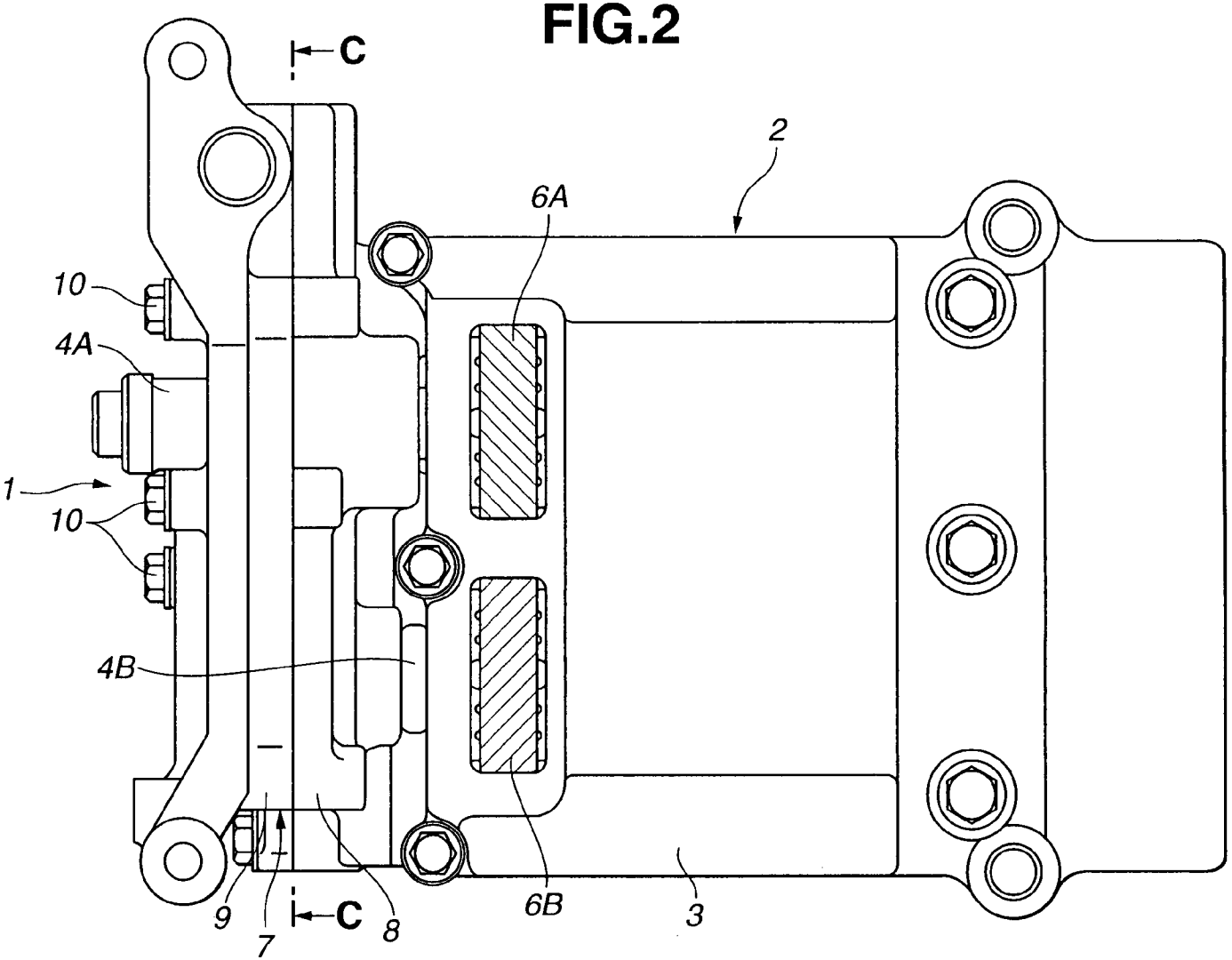
FIG. 2 is a top plan view of a balance apparatus, in connection with the first embodiment of the oil pump of FIG. 1.
Figure 3:
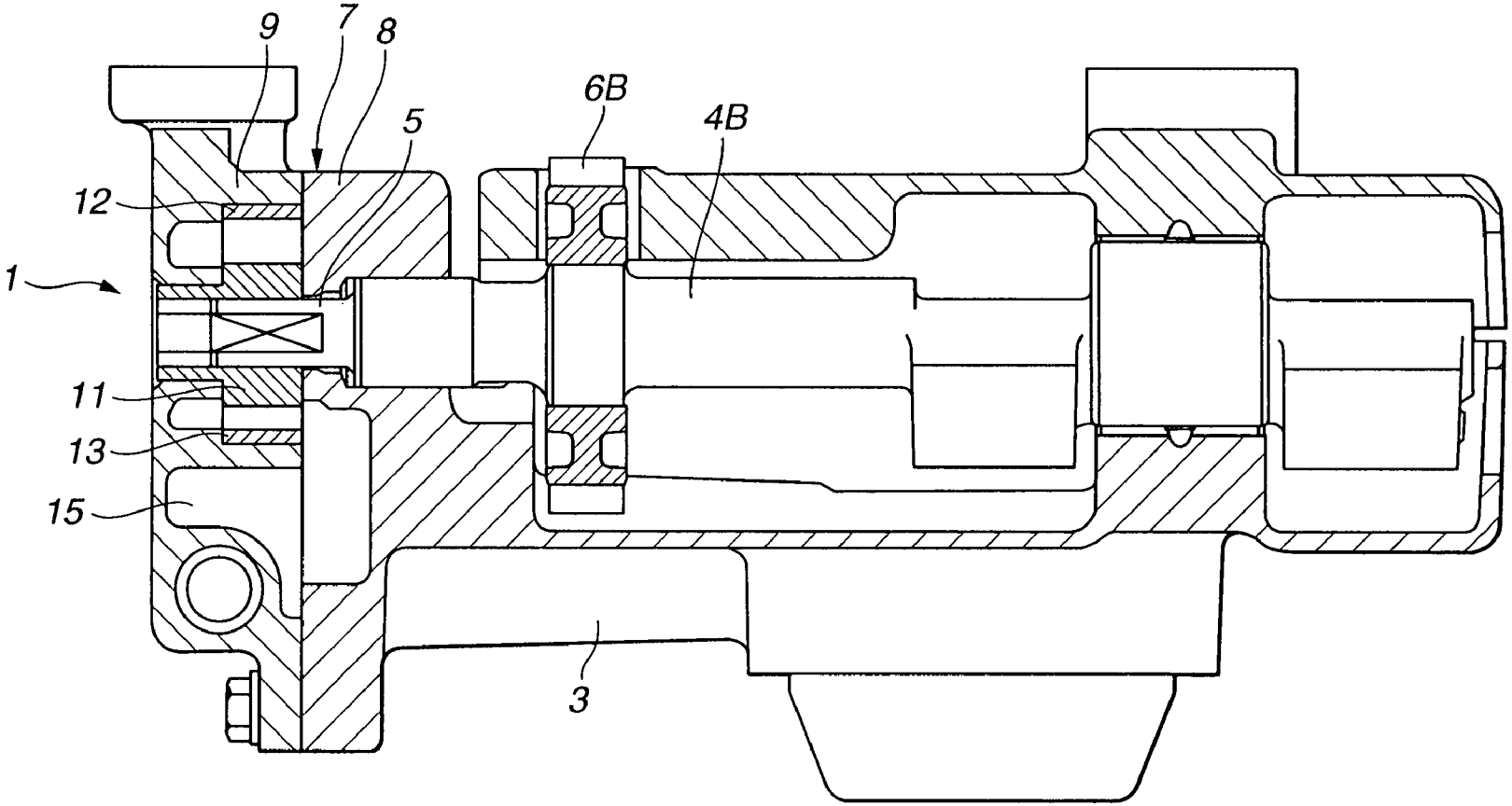
FIG. 3 is a cross-sectional view taken in the direction of allows substantially along the line A-A of FIG. 1.

Referring now to FIG. 1 to 4 of the drawings, an embodiment of an oil pump is illustrated. As shown in FIG. 2 and FIG. 3, an oil pump 1 is for an automotive vehicle and installed to a balance apparatus 2 of the vehicle.

As shown in FIG. 2, balance apparatus 2 includes a pair of balance shafts 4A and 4B. Synchronizing gears 6A and 6B are fixed respectively with balance shafts 4A and 4B and engaged with each other so as to be rotated in opposite directions. Accordingly, balance shaft 4A is rotated in synchronism with balance shaft 4B. Balance shaft 4A is connected with a crankshaft (not shown) of an engine (not shown) through a chain (not shown). Balance shaft 4B is arranged to drive oil pump 1. Balance shafts 4A and 4B are rotated at a speed of twice the rotational speed of the crank shaft. Balance shafts 4A and 4B have respective weights which are rotated to decrease secondary vibration of the engine. Balance apparatus 2 together with oil pump 1 is placed within an oil pan (not shown) at the bottom section of the engine.

Oil pump 1 includes a pump housing 7 which has a base block 8 and a cover block 9. Base block 8 is generally rectangular in section, and formed integrally on the front end section of a support frame 3 of balance apparatus 2. Cover block 9 is fixed to the front surface of base block 8. Blocks 8, 9 have respective outer peripheral sections which are connected with each other by a plurality of bolts 10. Oil pump 1 has a drive shaft 5 which corresponds to a front end section of balance shaft 4B which front end section is projected from a support frame 3 of balance apparatus 2.

A main unit of oil pump 1 is constituted of a trochoid type pump. The main unit of oil pump 1 includes an inner rotor 11 which is installed to drive shaft 5 to rotate with drive shaft 5 as a single unit. The main unit of oil pump 1 also includes an outer rotor 13 which is rotatably accommodated in a concave section 12 of cover block 9. Inner rotor 11 and outer rotor 13 have a plurality of outer teeth and a plurality of inner teeth, respectively, which are formed according to a trochoid curve. The number of the inner teeth of outer rotor 13 is larger by one than that of the outer teeth of inner rotor 11.

Inner rotor 11 is placed inside an inner periphery side of outer rotor 13 and eccentric to outer rotor 13. The outer teeth of inner rotor 11 are engaged with the inner teeth of outer rotor 13 at a most eccentric section (indicated at E in FIG. 1) of inner rotor 11. The remaining teeth of inner rotor 11 are slidably contacted with the inner teeth of outer rotor 13 at the plurality of positions in a circumferential direction. A plurality of spaces are formed between the contacted positions of inner rotor 11 and outer rotor 13 to serve as a plurality of pump chambers 14. The volumes of the plurality of pump chambers 14 are continuously changed to increase and decrease with the rotation of inner rotor 11.

As shown in FIG. 1, the main unit (11, 13) of oil pump 1 is located one-sided to an upper portion of the one-side section of pump housing 7 which is laterally long. A suction port 15 is formed at a lower side of the oil pump main unit (11, 13) within pump housing 7. Through the suction port 15, oil within an oil pan (not shown) is sucked into a suction area which means pump chambers 14 which are communicated with suction port 15. Pump housing 7 is also formed with a discharge port 16 through which the oil discharged from a discharge area of the oil pump main unit (11, 13) is introduced to a discharge passage (not shown). The discharge area means pump chamber 14 which are communicated with discharge port 16. The discharge passage means a passage through which the oil discharged through discharge port 16 is introduced to the engine. Discharge port 16 is extended from the oil pump main unit and generally U-shaped to bypass balance shaft 4A, and extended obliquely upward to form an extension end which is connected to the discharge passage.

As shown in FIG. 1, pump housing 7 is also formed with an oil chamber 18 which is connected with discharge port 16 through a communicating hole 17. Oil chamber 18 is formed extended generally along the lower side of an upper extension area 16*a* of discharge port 16. Through communicating hole 17 serving as an oil entrance, a vertically upper side of oil chamber 18 is communicated with discharge port 16. Oil chamber 18 is formed to have a resonance frequency which differs from that of discharge port 16.

Figure 4:
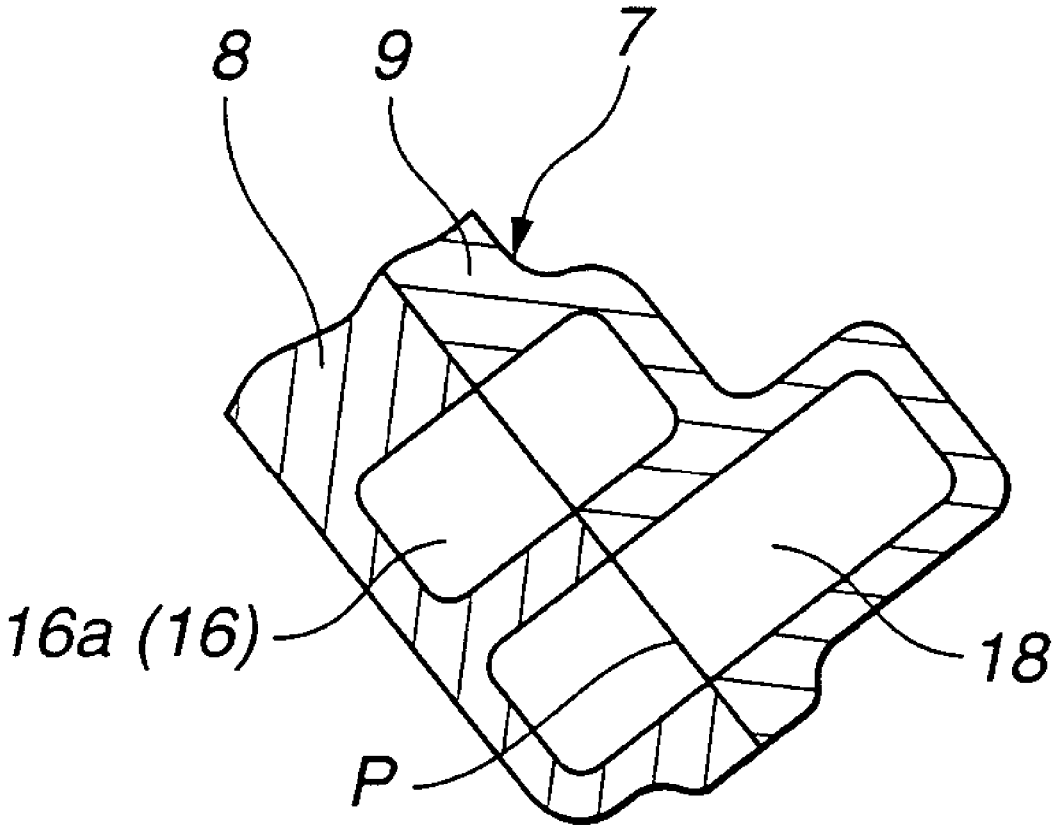
FIG. 4 is a fragmentary cross-sectional view taken in the direction of allows substantially along the line B-B of FIG. 1.

As shown in FIG. 4, each of discharge port 16 and oil chamber 18 is constituted of two sections which are located on the opposite sides of a partition plane P between base block 8 and cover block 9. An upper side wall 18*a* defining an upper part of oil chamber 18 is inclined relative to a horizontal plane or direction in order that communicating hole 17 is located at the vertically upper side of oil chamber 18. It will be understood that the horizontal plane or direction generally corresponds to the flat surface of a floor (not shown) of the vehicle. A cross-sectional area of communicating hole 17 is smaller than that of oil chamber 18. An end section of communicating hole 17 connected with discharge port 16 has such an opening area (cross-sectional area) oil can be kept at its end section under the surface tension of oil.

A reference numeral 19 in FIG. 1 designates a relief valve 19 which is disposed in a returning passage 20 communicating discharge port 16 with suction port 15.

Oil pump 1 according to the present invention is arranged as described above. Therefore, when balance shaft 4B is rotated with starting of the engine, the volumes of the plurality of pump chambers 14 are continuously changed with the rotation of inner rotor 11. Then, oil sucked from suction port 15 is continuously discharged into discharge port 16. Discharged oil has pulse pressure; however, the pulse pressure is certainly damped under the action of oil chamber 18 which is located parallel with discharge port 16 and communicated with discharge port 16 through communicating hole 17.

More specifically, a small amount of air is contained in oil which is introduced within oil chamber 18, and therefore the pulse pressure discharged through discharge port 16 acts on communicating hole 17, and damped because the volume of oil within oil chamber 18 is slightly changed. Oil chamber 18 is arranged such that its resonance frequency is different from that of discharge port 16 so that the pulse pressures in discharge port 16 and oil chamber 18 always interfere with each other. As a result, in oil pump 1 according to the present invention, pulse pressure discharged through discharge port 16 can be effectively damped in a wide range of frequencies.

Also in oil pump 1 according to the present invention, the vertically upper side of oil chamber 18 is communicated with discharge port 16 through communicating hole 17. Consequently, even if the engine stops for a long time so that oil will drop and leave from discharge port 16, oil within oil chamber 18 does not drop and leave. Therefore, it is not happened that a large amount of air is introduced into oil chamber 18 when the engine stops. This prevents arising of a problem that air is rapidly discharged from discharge port 16 in a certain engine speed range after engine starting thereby abruptly changing a pulse pressure performance.

In oil pump 1 according to this embodiment, upper wall 18*a* defining the upper part of oil chamber 18 is inclined in such a manner that it rises upward in a direction toward communicating hole 17 so that the air introduced into oil chamber 18 is effectively ejected toward discharge port 16. Even in the case that oil within discharge port 16 completely leaves discharge port 16 upon engine stopping, an oil level in communicating hole 17 is not dropped because the diameter of the upper end section of communicating hole 17 is sufficiently small to keep oil on the upper end section of communicating hole 17 under the action of the surface tension of the oil. Therefore, this prevents an occurrence of a problem that air remaining at the upper section of communicating hole 17 enters oil chamber 18 when oil is introduced to discharge port 16 when the engine restarts.

Figure 5:
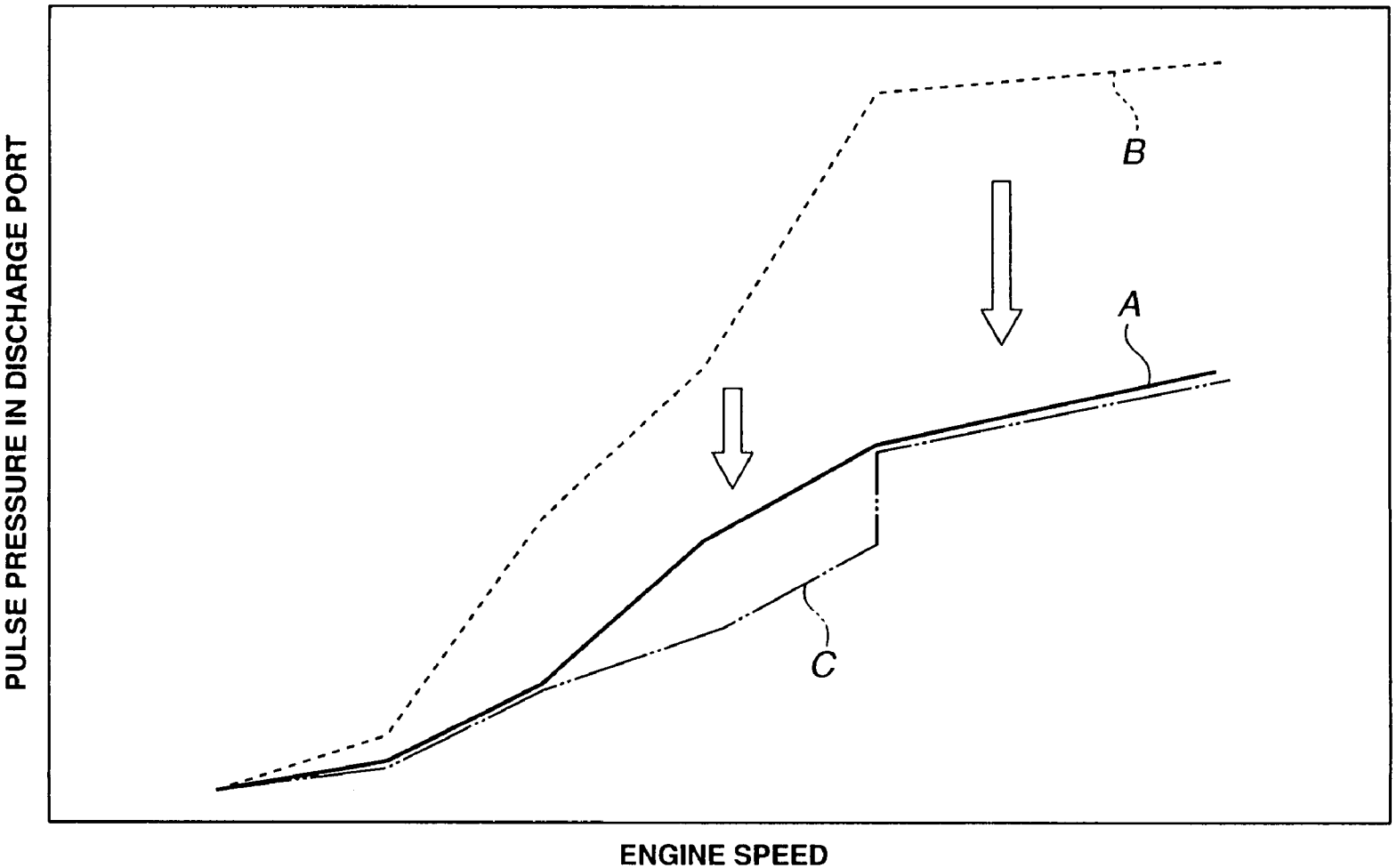
FIG. 5 is a graph showing the relationship between pulse pressure in a discharge port of oil pumps and engine speed of an engine, comparing the first embodiment of the oil pump according to the present invention and two earlier technology pumps.

FIG. 5 shows a comparison in pulse pressure characteristics among oil pump 1 of this embodiment being provided with oil chamber 18, a first comparative oil pump being not provided with both of the oil chamber and an air chamber like that in the conventional oil pump described in the Background of the Invention, and a second comparative oil pump being provided with the air chamber. More specifically, the first comparative oil pump is similar in construction to the oil pump of this embodiment with the exception that none of the oil chamber and the air chamber is provided, and the second comparative oil pump is similar in construction to the oil pump of this embodiment with the exception that the air chamber is provided in place of the oil chamber. The pulse pressure characteristics in FIG. 5 is of the relationship between the pulse pressure in discharge port 16 and the engine speed of the engine, in which a line A indicates the characteristics of the oil pump of this embodiment; a line B indicates the characteristics of the first comparative oil pump; and a line C indicates the characteristics of the second comparative oil pump. From this graph, it will be apparent that the level of the pulse pressure is certainly lowered in all engine speed ranges in oil pump 1 of the present embodiment as compared with the oil pump being not provided with any chamber. Additionally, in oil pump 1 of this embodiment, a linear pulse pressure characteristic that the pulse pressure level is generally proportional to an increase in the engine speed can be obtained, without raising a problem that the pulse pressure level rapidly rises during rise of the engine speed like in the oil pump being provided with the air chamber.

While the invention has been described in its preferred embodiment, it will be understood that the invention is not limited to the above description. In the embodiment as discussed above, while the main unit of pump 1 is arranged as the trochoid type pump, the main unit may be arranged as a vane pump or the like in which the volumes of a plurality of pump chambers are continuously changed to increase and decrease. Additionally, the main unit of the oil pump is not necessarily driven upon being directly connected with the balance shaft. However, in case that the main unit of the oil pump is driven by the balance shaft rotating at high speeds like those of this embodiment, a high frequency pulse pressure tends to be easily generated. Accordingly it is particularly effective to employ a measure with the oil chamber of the present invention.

Next, other features and effects of the present invention derived from the description of this embodiment will be discussed.

(A) The communication hole is smaller in cross-sectional area than the oil chamber. Additionally, the oil chamber is different in resonance frequency from the discharge port.

In this case, the pulse pressure discharged through the discharge port and the vibration in the oil chamber always interfere with each other so that the pulse pressure discharged through the discharge port can be effectively damped in a wide range of frequencies.

(B) The main unit of the oil pump is driven by the balance shaft which decreases secondary vibration of an engine. The balance shaft rotates at the speed of twice the rotational speed of the crankshaft.

In this case, the drive shaft rotates at the speed of twice the rotational speed of the crank shaft with the balance shaft as a single unit so that the frequency of the pulse pressure is entirely increased while the level of the pulse pressure rises. However, the oil pump as arranged in the above (B) has the oil chamber which prevents the problem that a large amount of air remains in the oil chamber, so that the oil chamber is effective to the oil pump under the condition that the level of the pulse pressure rises as described above.

(C) The main unit of the oil pump is the trochoid type pump including the inner rotor and the outer rotor. The inner rotor is driven by the drive shaft and provided at its outer periphery portion with a plurality of outer teeth having the shape of a trochoid curve. The outer rotor is disposed at the outer peripheral side of the inner rotor and eccentric to the inner rotor. The outer rotor is provided at its inner peripheral portion with a plurality of inner teeth having the shape of a trochoid curve. The inner teeth are in engagement with the outer teeth of the inner rotor.

In this case, a plurality of pump chambers formed between the inner rotor and the outer rotor sequentially open to discharge oil toward the discharge port with rotation of the drive shaft, in which the pulse pressure discharged to the discharge port is certainly decreased in the oil chamber.

The entire contents of Japanese Patent Application No. 2003-386128, filed Nov. 17, 2003, is incorporated herein by reference.

What is claimed is:

1. An oil pump comprising:

a section defining a suction port;

a section defining a discharge port having a portion;

a main unit including a section defining a plurality of pump chambers, volume of each pump chamber continuously changing to increase and decrease under driving of an engine so as to pressurize oil sucked through the suction port and discharge the oil through the discharge port with a pulse pressure; and a section defining an oil chamber to which the oil flows, the oil chamber having only one single communicating hole, the oil chamber having an upper portion which is communicated with the portion of the discharge port through the single communicating hole, wherein the portion of the discharge port is located higher in a vertical direction than the upper portion of the oil chamber, and wherein the oil chamber is configured to dampen the pulse pressure discharged through the discharge port.

2. An oil pump as claimed in claim 1, wherein the single communicating hole is smaller in cross-sectional area than the oil chamber, the oil chamber being different in resonance frequency from the discharge port.

3. An oil pump as claimed in claim 1, wherein the main unit is driven by a balance shaft which decreases secondary vibration of an engine, the balance shaft rotating at a speed of twice a rotational speed of a crankshaft.

4. An oil pump as claimed in claim 1, wherein the main unit is a trochoid type pump including an inner rotor and an outer rotor, the inner rotor being driven by a drive shaft and provided at its outer periphery portion with a plurality of outer teeth having a shape of a trochoid curve, the outer rotor being disposed at an outer peripheral side of the inner rotor and eccentric to the inner rotor, the outer rotor being provided at its inner peripheral portion with a plurality of inner teeth having a shape of a trochoid curve, the inner teeth being in engagement with the outer teeth of the inner rotor.

5. An oil pump as claimed in claim 1, further comprising a pump housing including a base block and a cover block installed to a front surface of the base block, wherein each of the discharge port and the oil chamber includes two sections which are located on opposite sides of a partition plane between the base block and the cover block, the base block and the cover block being joined by a plurality of bolts.

6. An oil pump as claimed in claim 1, wherein the oil chamber is arranged such that oil within the oil chamber cannot drop and leave from the oil chamber even if the engine stops for a long time.

7. An oil pump as claimed in claim 1, wherein the oil chamber is formed along the discharge port.

8. An oil pump as claimed in claim 1, further comprising a relief valve, the discharge port having a first portion to which the relief valve is fluidly connected, and a second portion with which the oil chamber is communicated, the first portion being upstream of the second portion.

9. An oil pump comprising:

a section defining a suction port;

a section defining a discharge port having a portion;

a main unit including a section defining a plurality of pump chambers, volume of each pump chamber continuously changing to increase and decrease under driving of an engine so as to pressurize oil sucked through the suction port and discharge the oil through the discharge port with a pulse pressure;

a section defining an oil chamber to which the oil flows, the oil chamber having only one single communicating hole, the oil chamber having an upper portion which is communicated with the portion of the discharge port through the single communicating hole; and an upper wall defining an upper part of the oil chamber, the upper wall having an inner surface which is inclined relative to a horizontal direction in a manner that the communicating hole is located at the upper portion of the oil chamber, wherein the portion of the discharge port is located higher in a vertical direction than the upper portion of the oil chamber, and wherein the oil chamber is configured to dampen the pulse pressure discharged through the discharge port.

10. An oil pump as claimed in claim 9, wherein the single communicating hole is smaller in cross-sectional area than the oil chamber, the oil chamber being different in resonance frequency from the discharge port.

11. An oil pump as claimed in claim 9, wherein the main unit is driven by a balance shaft which decreases secondary vibration of an engine, the balance shaft rotating at a speed of twice a rotational speed of a crankshaft.

12. An oil pump as claimed in claim 9, wherein the main unit is a trochoid type pump including an inner rotor and an outer rotor, the inner rotor being driven by a drive shaft and provided at its outer periphery portion with a plurality of outer teeth having a shape of a trochoid curve, the outer rotor being disposed at an outer peripheral side of the inner rotor and eccentric to the inner rotor, the outer rotor being provided at its inner peripheral portion with a plurality of inner teeth having a shape of a trochoid curve, the inner teeth being in engagement with the outer teeth of the inner rotor.

13. An oil pump as claimed in claim 9, wherein the oil chamber is arranged such that oil within the oil chamber cannot drop and leave from the oil chamber even if the engine stops for a long time.

14. An oil pump as claimed in claim 9, wherein the oil chamber is formed along the discharge port.

15. An oil pump comprising:

a section defining a suction port;

a section defining a discharge port having a portion;

a main unit including a section defining a plurality of pump chambers, volume of each pump chamber continuously changing to increase and decrease under driving of an engine so as to pressurize oil sucked through the suction port and discharge the oil through the discharge port with a pulse pressure;

a section defining an oil chamber to which the oil flows, the oil chamber having only one single communicating hole, the oil chamber having an upper portion; and a section defining the single communicating hole through which the upper portion of the oil chamber is communicated with the portion of the discharge port, the single communicating hole having an adjacent portion which is adjacent the discharge port, the adjacent portion having an opening area for keeping oil within the adjacent portion under surface tension of oil, wherein the portion of the discharge port is located higher in a vertical direction than the upper portion defined in the oil chamber, and wherein the oil chamber is configured to dampen the pulse pressure discharged through the discharge port.

16. An oil pump as claimed in claim 15, wherein the single communicating hole is smaller in cross-sectional area than the oil chamber, the oil chamber being different in resonance frequency from the discharge port.

17. An oil pump as claimed in claim 15, wherein the main unit is driven by a balance shaft which decreases secondary vibration of an engine, the balance shaft rotating at a speed of twice a rotational speed of a crankshaft.

18. An oil pump as claimed in claim 15, wherein the main unit is a trochoid type pump including an inner rotor and an outer rotor, the inner rotor being driven by a drive shaft and provided at its outer periphery portion with a plurality of outer teeth having a shape of a trochoid curve, the outer rotor being disposed at an outer peripheral side of the inner rotor and eccentric to the inner rotor, the outer rotor being provided at its inner peripheral portion with a plurality of inner teeth having a shape of a trochoid curve, the inner teeth being in engagement with the outer teeth of the inner rotor.

19. An oil pump as claimed in claim 15, wherein the oil chamber is arranged such that oil within the oil chamber cannot drop and leave from the oil chamber even if the engine stops for a long time.

20. An oil pump as claimed in claim 15, wherein the oil chamber is formed along the discharge port.

21. An oil pump as claimed in claim 1, wherein the upper portion of the oil chamber is an uppermost portion located at an uppermost site of the oil chamber.

* * * * *